US010426256B2

(12) United States Patent
Boucherie

(10) Patent No.: US 10,426,256 B2
(45) Date of Patent: Oct. 1, 2019

(54) BRISTLE INSERT, BRUSH WITH SUCH BRISTLE INSERT, AND METHOD FOR MANUFACTURING SUCH BRISTLE INSERT

(75) Inventor: Bart Gerard Boucherie, Izegem (BE)

(73) Assignee: Bart Gerard Boucherie (BE)

( * ) Notice: Subject to any disclaimer, the term of this patent is extended or adjusted under 35 U.S.C. 154(b) by 0 days.

(21) Appl. No.: 13/259,357

(22) PCT Filed: Mar. 17, 2010

(86) PCT No.: PCT/EP2010/001693

§ 371 (c)(1),
(2), (4) Date: Oct. 12, 2011

(87) PCT Pub. No.: WO2010/108624

PCT Pub. Date: Sep. 30, 2010

(65) Prior Publication Data

US 2012/0023692 A1 Feb. 2, 2012

(30) Foreign Application Priority Data

Mar. 27, 2009 (DE) ..... 10 2009 015 338

(51) Int. Cl.

| | |
|---|---|
| ***A46B 3/04*** | (2006.01) |
| ***A46B 3/00*** | (2006.01) |
| ***A46D 3/04*** | (2006.01) |
| ***A46B 3/06*** | (2006.01) |
| *A46B 3/02* | (2006.01) |

(52) U.S. Cl.

CPC ..... *A46D 3/045* (2013.01); *A46B 3/06* (2013.01); *A46B 3/00* (2013.01); *A46B 3/02* (2013.01); *A46B 2200/202* (2013.01)

(58) Field of Classification Search

CPC ..... A46B 3/00; A46B 3/02
USPC ..... 15/191.1, 192, 193; 300/21
See application file for complete search history.

(56) References Cited

U.S. PATENT DOCUMENTS

| | | | | |
|---|---|---|---|---|
| 1,452,502 | A * | 4/1923 | Gissler | 300/21 |
| 2,202,292 | A * | 5/1940 | Howard | 15/143.1 |
| 2,406,732 | A * | 8/1946 | Hardman | 300/21 |
| 3,300,808 | A * | 1/1967 | Karl | 401/288 |
| 3,875,608 | A * | 4/1975 | Weiss | 15/193 |
| 3,910,637 | A | 10/1975 | Lewis, Jr. | |
| 4,009,910 | A * | 3/1977 | Lewis, Jr. | 300/2 |
| 4,285,088 | A * | 8/1981 | Ripstein | 15/193 |
| 4,627,125 | A * | 12/1986 | Gruns | 15/105 |

(Continued)

FOREIGN PATENT DOCUMENTS

| | | |
|---|---|---|
| CN | 201022466 Y | 2/2008 |
| DE | 1072586 A | 7/1960 |

(Continued)

OTHER PUBLICATIONS

Unoffical English Translation to Weihrauch (EP 0329939 A2).*

(Continued)

*Primary Examiner* — Michael D Jennings
(74) *Attorney, Agent, or Firm* — Carlson, Gaskey & Olds, P.C

(57) ABSTRACT

A bristle insert, in particular for a brush, is formed by at least one bristle pack having a plurality of plastic bristles whose ends are fused to each other to form a self-supporting holding element. A brush with such a bristle insert, and a method for manufacturing such a bristle insert is also provided.

6 Claims, 6 Drawing Sheets

(56) References Cited

U.S. PATENT DOCUMENTS

| | | | | |
|---|---|---|---|---|
| 5,011,230 | A | 4/1991 | Schlerf | |
| 5,435,037 | A * | 7/1995 | Ledingham | 15/168 |
| 5,605,383 | A * | 2/1997 | Biocca | 300/21 |
| 5,636,904 | A * | 6/1997 | Bell et al. | 300/21 |
| 6,035,481 | A * | 3/2000 | Douglas et al. | 15/168 |
| 6,408,474 | B1 * | 6/2002 | Husted et al. | 15/143.1 |
| 6,510,578 | B1 * | 1/2003 | Cyr et al. | 15/176.6 |
| 8,091,172 | B2 * | 1/2012 | Cox et al. | 15/204 |
| 2001/0020315 | A1 * | 9/2001 | Lallement et al. | 15/192 |
| 2002/0180253 | A1 * | 12/2002 | Buchholz et al. | 300/2 |
| 2003/0005533 | A1 * | 1/2003 | Woodnorth et al. | 15/143.1 |
| 2003/0163884 | A1 * | 9/2003 | Weihrauch | 15/207.2 |
| 2004/0055100 | A1 * | 3/2004 | Sartori | 15/191.1 |
| 2004/0187244 | A1 * | 9/2004 | Giertz | 15/180 |
| 2008/0313836 | A1 * | 12/2008 | Hobbs | 15/193 |
| 2009/0007356 | A1 | 1/2009 | Cox et al. | |

FOREIGN PATENT DOCUMENTS

| | | | | |
|---|---|---|---|---|
| DE | 3712962 | A1 | 11/1988 | |
| DE | 102004020713 | A1 | 12/2005 | |
| EP | 0329939 | A2 * | 8/1989 | A46B 3/04 |
| FR | 2769477 | A1 | 4/1999 | |
| FR | 2797755 | A1 | 3/2001 | |
| GB | 2370220 | A | 6/2002 | |
| JP | 11192795 | A * | 7/1999 | B43K 1/12 |
| WO | 200112013 | A1 | 2/2001 | |
| WO | 2004032673 | A1 | 4/2004 | |

OTHER PUBLICATIONS

Translation of International Search Report dated Oct. 6, 2011.
International Search Report dated Jun. 16, 2010.
Translation of office action from corresponding EP application, dated Dec. 9, 2015.

* cited by examiner

BRISTLE INSERT, BRUSH WITH SUCH BRISTLE INSERT, AND METHOD FOR MANUFACTURING SUCH BRISTLE INSERT

RELATED APPLICATION

This is the U.S. national phase application of PCT/EP2010/001693, filed Mar. 17, 2010, which claims priority to German Application No. 10 2009 015 338.1, filed 27 Mar. 2009.

TECHNICAL FIELD

This invention relates to a bristle insert for a brush, a brush with such a bristle insert, and a method for manufacturing such a bristle insert.

BACKGROUND OF THE INVENTION

The greatest problem in the manufacture of brushes consists in fixing the bristles. On the one hand, it must be possible to fix a sufficiently high number of bristles, in order to obtain the desired density of the bristle pack formed of the bristles. On the other hand, it must be ensured that the bristles are fixed in a reliable way, so that they do not fall out during usage.

One fixing method consists in inserting the bristles into a sleeve as a dense pack and adhering the ends of the bristles arranged in the sleeve to each other, for example by synthetic resin. Subsequently, the handle of the brush is connected with the sleeve. With this fixing method a very dense bristle pack can be obtained. However, the individual bristles are not held in a particularly reliable way. Another fixing method consists in fixing the bristles in holes by means of small clips, for example in a wooden body. With this fixing method it is possible in principle to fix the bristles comparatively well. However, the holes used for accommodating the bristles must have a comparatively great distance from each other, as otherwise the body containing the holes has no sufficient strength to hold the clips. The necessary distance of the holes from each other leads to the fact that the bristle pack is not particularly dense. This problem becomes even worse when natural bristles are used as bristles, for example pig hair. While, for example in synthetic bristles the clip can be arranged in the center of the U-shaped bristles and both ends of the bristle can be utilized, only one end can be utilized in bristles made of pig hair, namely the end opposite to the hair root. Hence it follows that the bristles must be designed longer than the actual bristle pack, since the end portion located in the interior of the brush is bent, so that it can be fixed by the clip. This is disadvantageous in terms of cost, since natural bristles are particularly expensive. In addition, a very small density of the bristle pack is obtained.

A brush should have low manufacturing costs, a dense bristle pack, and a reliable fixation of the individual bristles.

SUMMARY OF THE INVENTION

A bristle insert, in particular for a brush, is formed by at least one pack with an amount of plastic bristles whose ends are fused to each other such that a self-supporting holding element is formed. The basic idea underlying the invention is to mold the material of the plastic bristles such that it can directly be used for fixing the bristle insert at the brush. In this way, the number of components of which the corresponding brush is composed is reduced. In addition, a high density of the bristle pack is obtained, since it is not necessary for constructive reasons to provide gaps between individual bristle bundles.

In one example, it is provided that the holding element forms a fixing structure for fixing the bristle insert on a brush body. When fusing the ends of the plastic bristles, the plastic compound obtained thereby can be molded with little effort such that the fixing structure is formed.

Preferably, the holding element is a plate. The same can be accommodated in a brush body with little effort.

In accordance with one embodiment it is provided that the bristle pack includes a cavity adjacent to the holding element. The cavity can form a paint receiving space which serves as "storage space" for the paint. By the suitable arrangement and dimensions of this storage space it is influenced how much paint and how uniformly the paint reaches the bristle tips when painting.

The bristle insert can include a single bristle pack. In this way, a particularly high bristle density is achieved in the bristle insert.

Alternatively, the bristle insert also can include a plurality of bristle packs. By using a plurality of bristle packs there can also be formed cavities between the bristles of the bristle insert.

In accordance with one embodiment, the bristle pack can include different bristles. The bristles can differ in their thickness, their material, their color, etc.

It can also be provided that the bristle pack includes an amount of natural bristles. Although the natural bristles neither can melt nor solidify again, it is innocuous to use a certain amount of natural bristles, which are advantageous in terms of their properties. The natural bristles can automatically be anchored in the holding element, when the plastic bristles are molten and solidify again as a holding element. The upper limit for the amount of natural bristles (or generally for any kind of bristles which cannot be molten and then solidify again, so that the bristle material is converted to a holding element) is formed by the necessity that the plastic bristles provide a sufficient quantity of meltable material which can be converted into the holding element, and in which the other bristles then are also firmly anchored.

Preferably, the different bristles are arranged in a defined way, i.e. not randomly distributed in the bristle pack. In this way, certain desired properties of the bristle insert can be brought about, for example color accents, particular painting properties, etc.

A brush with a brush body is also provided with a bristle insert as described above. Such a brush has a small number of individual parts of which it is made, and has low manufacturing costs.

Preferably, the holding element is of a plate-like design and is accommodated in the brush body. A plate-like holding element facilitates fixing the bristle insert at the brush body.

The holding element can positively be accommodated in the brush body. For example, the brush body can include a circumferential groove or a similar formation in which the holding element is received.

Alternatively, the holding element can be adhered or welded to the brush body. With this type of connection of the bristle insert with the brush body, the same need not be designed undercut, which is advantageous for example in brush bodies made by an injection molding method.

It is also possible that the bristle insert is overmolded. In this embodiment, the bristle insert is inserted into an injection mold as a whole and then overmolded with the material which forms the brush body. A separate, subsequent assembly is hence not required.

In an example embodiment, it is provided that the brush body has a collar which surrounds the bristle pack. The collar supports the bristle pack, so that the bristles are held together well.

The brush body can be made of two parts which are connected with each other. The two parts in particular can be half shells which are made of plastic material and, when they are put together, receive the bristle insert between themselves.

A method for manufacturing a bristle insert comprises the following steps: A plurality of bristles is combined to a bristle pack, wherein the bristle pack includes a certain amount of plastic bristles. Then, the bristle pack is heated at one end, so that the plastic bristles melt. Subsequently, the molten end of the bristle pack is cooled, so that the molten material solidifies to form a holding element. In this way, a compact bristle insert can be created with little effort, in which all bristles are reliably fixed. The formed holding element also provides for the conditions of a simple fixation of the bristle insert at a brush.

Preferably, the molten end of the bristle pack is brought into a defined shape, before it solidifies. In this way, the holding element can be created in the desired shape and with the desired dimensions with little effort.

Preferably, a heating stamp is used to heat the end of the bristle pack and bring it into the defined shape. In this way, the number of the individual method steps is reduced, since the steps of heating and shaping are combined.

BRIEF DESCRIPTION OF THE DRAWINGS

The invention will be described below with reference to various embodiments which are represented in the attached drawings, in which.

DETAILED DESCRIPTION

Figure 1:
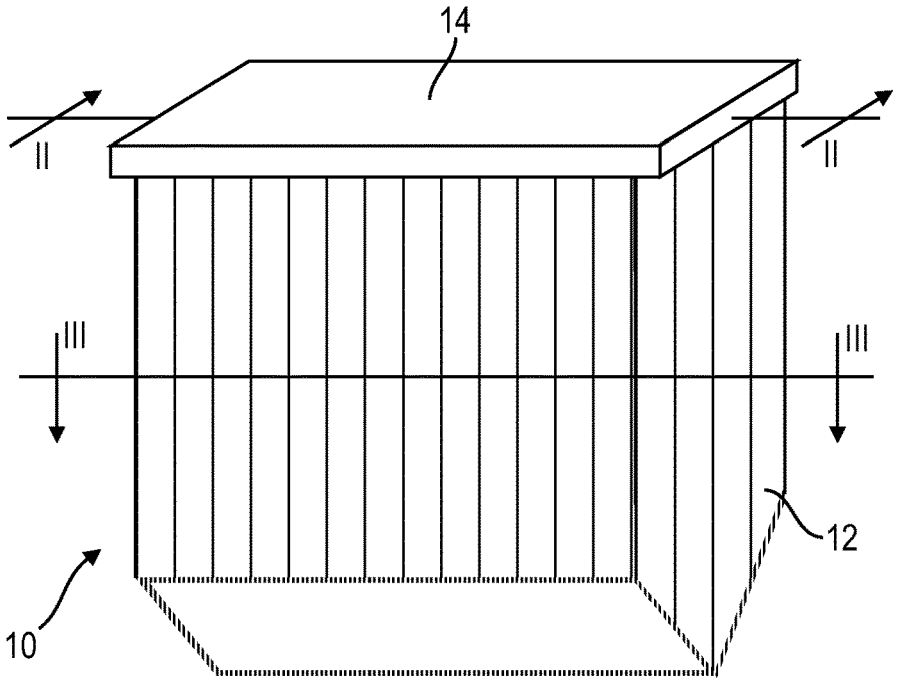
FIG. 1 shows a schematic, perspective view of a bristle insert according to the invention.

FIG. 1 shows a bristle insert 10 which includes a plurality of bristles 12 arranged resting against each other, and which at least for a certain part are made of plastic material. After having been combined to a dense pack, all bristles 12 have been heated at one end to such an extent that the plastic material has liquefied, whereby the ends of the plastic bristles 12 are fused with each other. After the plastic material has cooled and solidified, a self-supporting structure or a self-supporting holding element 14 has been formed in this way, which is made of the material of the bristles, and in which all bristles are anchored. The holding element 14 is designed here as a rectangular plate.

Figure 2:
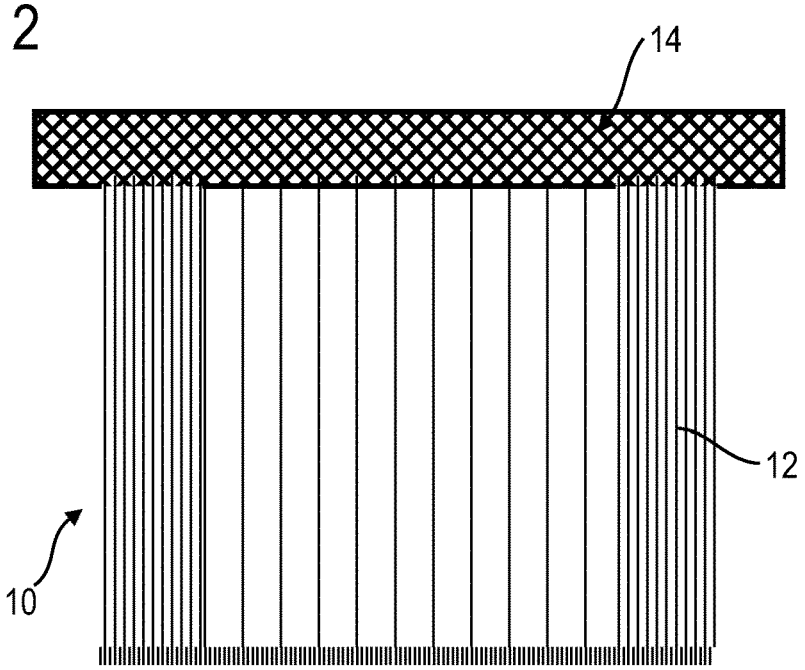
FIG. 2 shows a section along the plane II-II of FIG. 1.
Figure 3A:
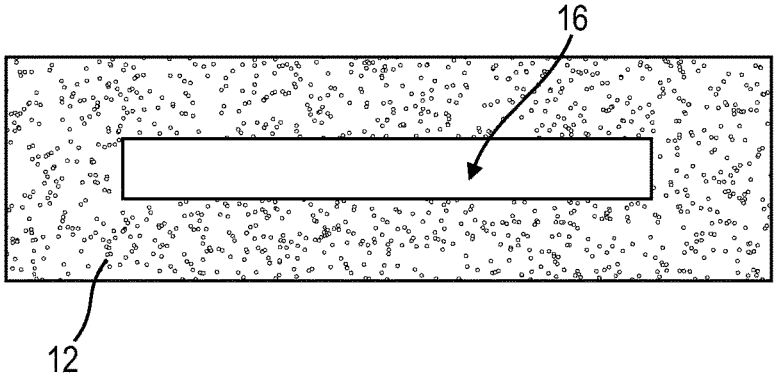
FIG. 3*a* shows a design variant of the bristle insert in a section along the plane III-III of FIG. 1.
Figure 3B:
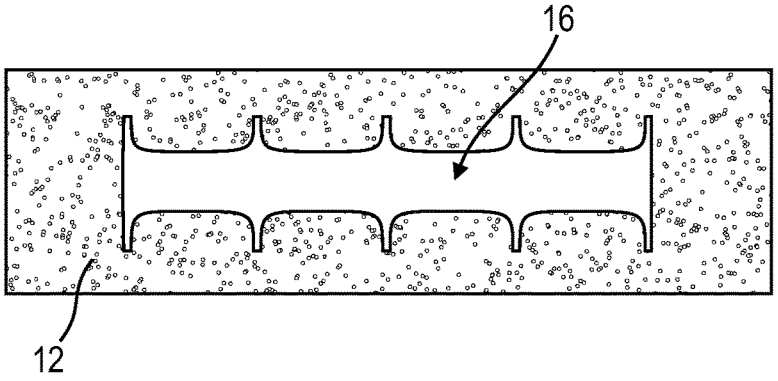
FIG. 3*b* shows a second design variant of a bristle insert.

As shown in FIG. 1, the free ends of the bristles 12, i.e. the ends facing away from the holding element 14, are not located at one level, but are arranged in a generally V-shaped manner. As shown in FIGS. 2 and 3*a*-3*c*, the bristles 12 are combined to a pack such that in the center a cavity 16 is formed, which is comparatively sharply delimited in direct vicinity of the holding element 14. With increasing distance from the holding element 14, more and more bristles will extend into the region of the cavity 16, so that the same can almost not, or even no more, at all be recognized in the region of the free ends. As shown in FIG. 3*a*, the cavity 16 can have a rectangular shape. FIG. 3*b* shows an alternative in which the cavity 16 is provided with protrusions extending to the outside. Other designs are also possible. The cavity 16 serves as storage space for paint, which from there spreads into the bristles and is dispensed from the same to the object to be painted.

As shown in FIGS. 3*a* and 3*b*, the bristles 12 of the bristle pack are arranged as a dense pack. In this embodiment, a single pack is used. Alternatively, it is also possible to use two or more separate packs, i.e. a plurality of dense packs which are separated from each other by a gap, but nevertheless are connected with each other by a single holding element made of the material of the bristles.

Figure 3C:
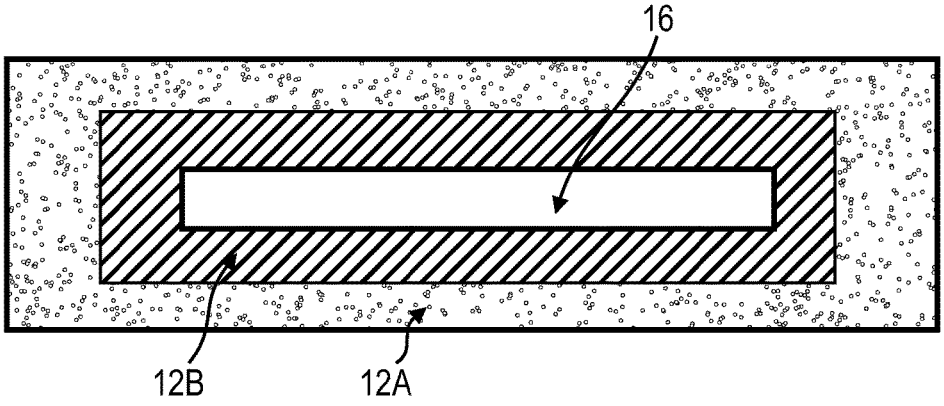
FIG. 3*c* shows a third design variant of a bristle insert.

FIG. 3*c* shows a bristle pack which is comprised of two different types of bristles. Circumferentially on the outside, a dense pack of a first type of bristles 12A is arranged, and circumferentially on the inside a pack of a second type of bristles 12B is arranged, with no gap being provided between the two packs. In the interior a rectangular cavity 16 is provided, which serves as storage space for paint.

Figure 4:
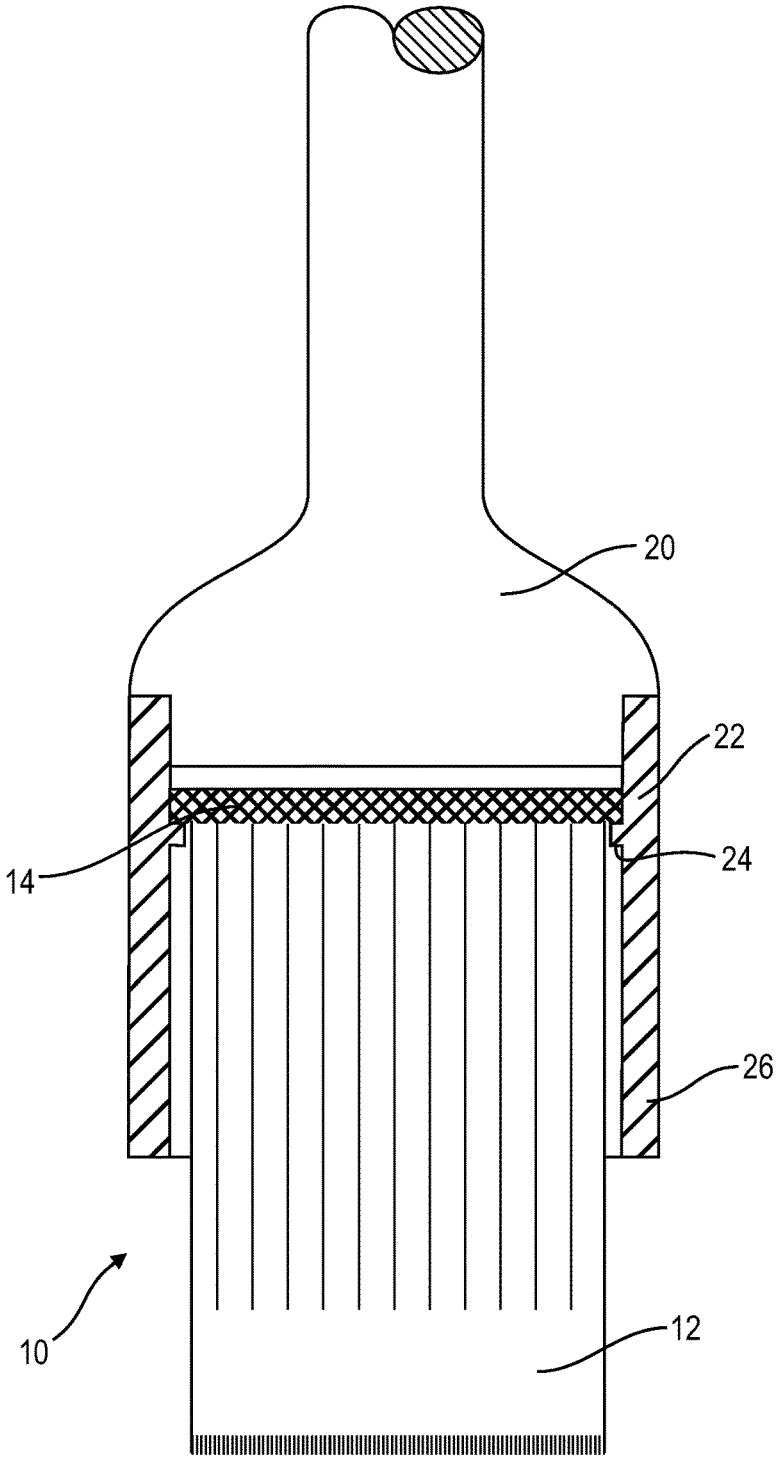
FIG. 4 shows a schematic sectional view of a brush according to an embodiment of the invention.

FIG. 4 shows a brush which includes a brush body 20, a sleeve 22 and the bristle insert 10. The brush body 20 forms the handle and is provided with the sleeve 22. On its inside, the sleeve 22 includes a circumferential shoulder 24, with the plate-like holding element 14 resting on the shoulder 24. Since the brush body 20 is inserted into the sleeve 22, the holding element 14 is fixed between the brush body 20 and the circumferential shoulder 24. On the side facing away from the brush body 20, the sleeve 22 is provided with a circumferential collar 26 which surrounds the bristles 12 of the bristle insert 10 and in use of the brush supports the same and holds them together.

The sleeve 22 provided with the collar 26 can be adhered to the brush body 20, be firmly connected by small nails, or be attached to the same in some other way.

Figure 5:
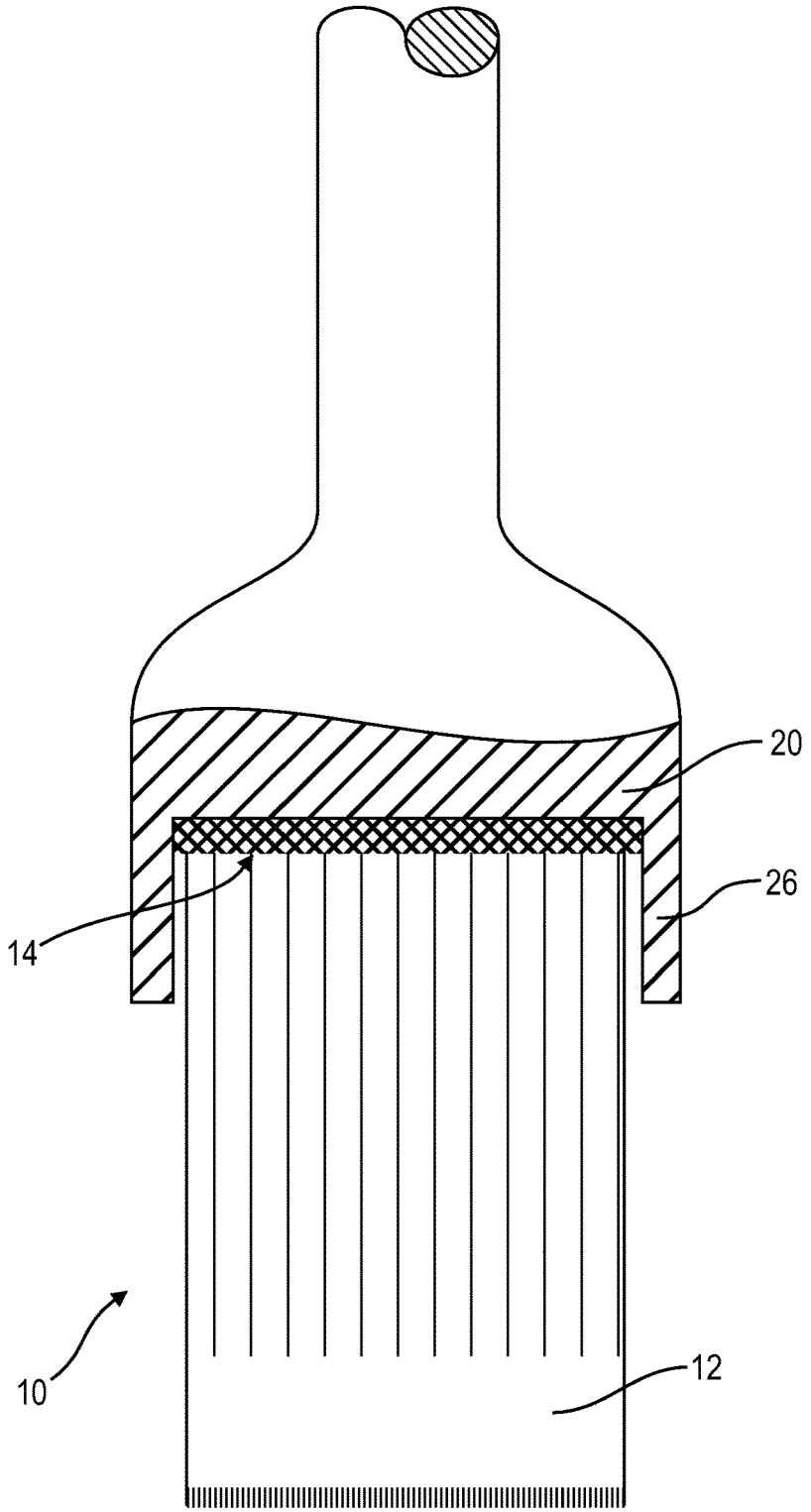
FIG. 5 shows a partly sectional view of a brush according to a second embodiment of the invention.

FIG. 5 shows a brush in which the collar 26 is integrally formed with the brush body 20. The collar 26 surrounds a receptacle into which the bristle insert 10 is inserted, in particular the holding element 14 which here has a plate-like shape. The holding element 14 can be adhered or welded to the brush body 20. It is also possible to directly mold the brush body 20 onto the holding element 14.

Figure 6:
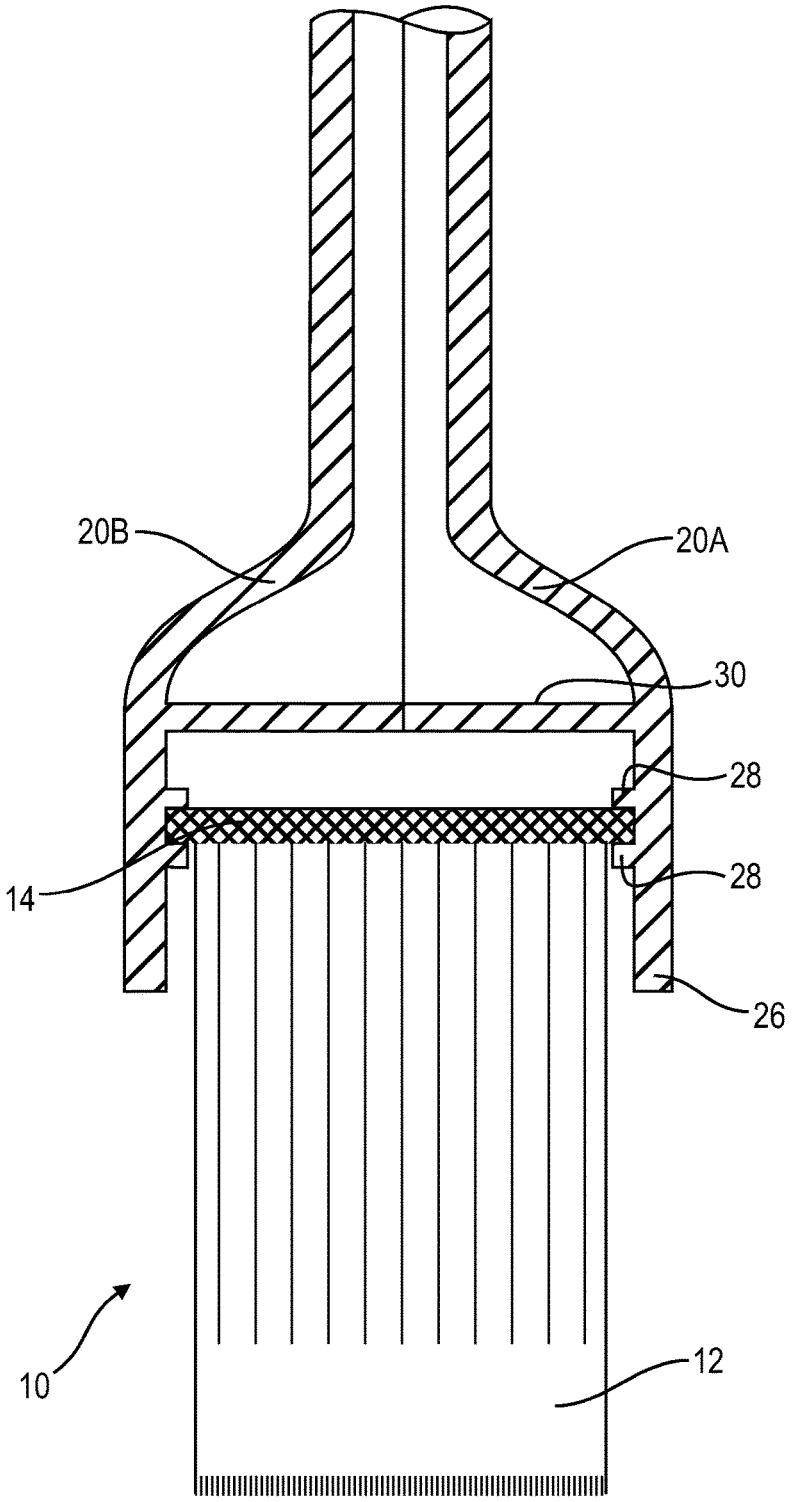
FIG. 6 shows a schematic sectional view of a brush according to a third embodiment.

FIG. 6 shows a brush whose brush body is made of two parts 20A, 20B, in particular of two half shells. Here, a collar 26 is also provided, which forms a receptacle for the holding element 14 of the bristle insert 10. In the interior of the collar two circumferential shoulders 28 are provided, between which the holding element 14 is received. The receptacle in the interior of the collar 26 is closed towards the handle of the brush by a bottom 30 which serves for stabilization. The bottom 30 also prevents paint from getting into the interior of the brush body 20.

The two parts 20A, 20B can be welded to each other, in particular by ultrasonic welding, or can alternatively be adhered to each other, or can be mechanically connected with each other, for example they can be clipped together.

The two parts 20A, 20B form a hollow handle which leads to a brush with very low weight. In addition, the two shell-like parts can very easily be manufactured in an injection mold, since each shell can easily be removed from the mold; the mold release plane extends centrally through the handle. With this design, the collar also can easily be integrated, and for example, be designed conically tapered. The two shells of the handle can be reinforced by ribs in the interior, so that even if a low wall thickness is used, the handle cannot be compressed. The two shells can be designed as a multi-component part, so that for example in the handle region two portions of a plastic material are molded onto the two shells, which plastic material is softer than the material of the two shells, for example a thermoplastic elastomer. Such softer plastic material improves the grasp feeling and can be arranged in a suitable way depending on the requirement, for example as a support for the thumb and/or the index finger of the user. It is also possible that the collar made of a yielding material is molded onto the two shells which form the handle. In this way, a yielding support is obtained for the bristle pack within certain limits. It is also possible to only partly mold the collar of the yielding material, whereas other parts are made of the same, harder material like the handle.

Figure 7:
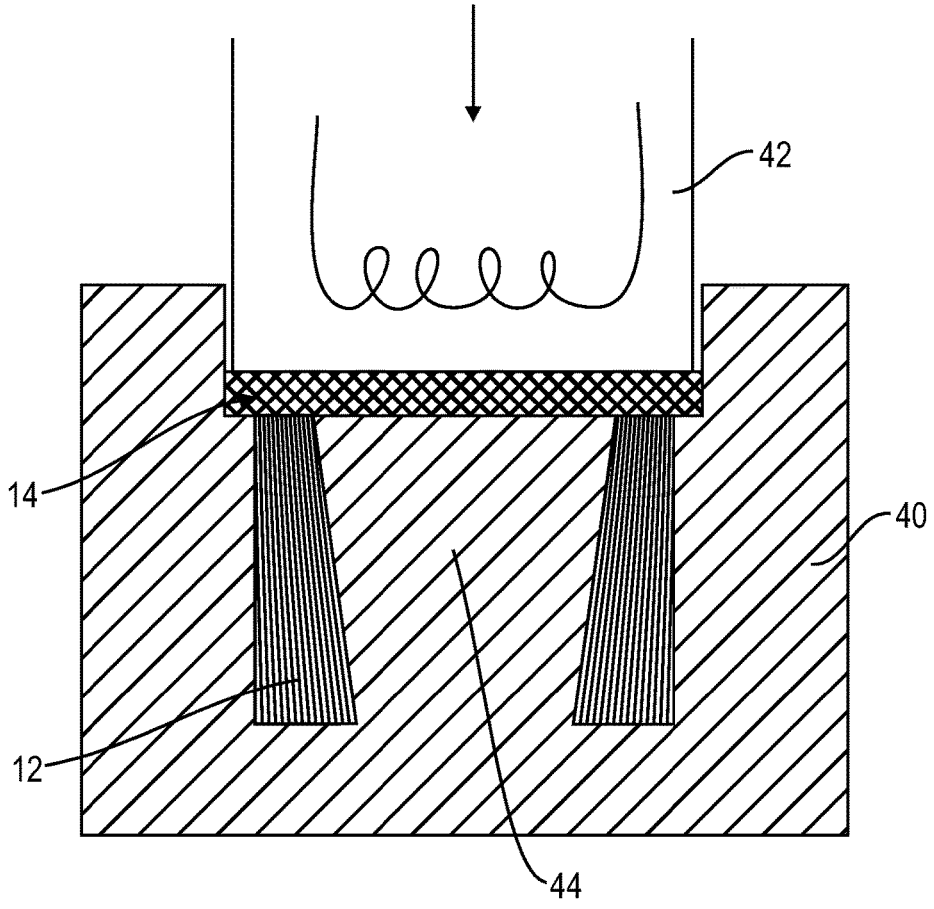
FIG. 7 shows a schematic sectional view of an apparatus for manufacturing a bristle pack.

The bristle insert 10 is manufactured in that the desired quantity of bristles 12 is combined to the desired pack in a holding device 40 (see FIG. 7). Then, the ends of the bristles to be connected with each other are molten. Here, this is effected with a heating stamp 42, so that they are all fused to each other. The stamp also is used to transform the molten material of the plastic bristles to the holding element 14, which later on will be used for fixing the bristle insert at the brush. After the molten material has solidified again, the bristle insert can be removed from the holding device and be processed further.

By way of example, FIG. 7 shows a holding device for a bristle insert, which includes a cavity in its interior. For this purpose, the holding device is provided with a spacer 44 which defines the cavity. The heating stamp 42 will melt so much material of the bristles that enough material is displaced into the region "above" the spacer 44 in order to form a continuous holding element, i.e. from the bristles on one side towards the bristles on the other side. The holding element, formed here as a plate, thus is completely closed despite the cavity and extends continuously over the entire bristle pack. This ensures that the cavity formed in the interior of the bristle pack has a defined volume, which is laterally sealed off by the bristles arranged close to each other, and on the side facing away from the free ends of the bristles by the holding element, as is shown in FIG. 2.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A brush comprising:

a brush body comprising a handle;

a bristle insert attached to the handle and including at least one bristle pack with a plurality of plastic bristles having ends that are fused to each other to form a self-supporting holding element, wherein the at least one bristle pack includes different bristles that differ from each other in at least one of bristle thickness, bristle material, or bristle color; and wherein the self-supporting holding element is a plate, and wherein the bristle pack includes a cavity adjacent to the self-supporting holding element, and wherein the cavity is comparatively sharply delimited in direct vicinity of the self-supporting holding element, and wherein more bristles extend into the cavity at an increasing distance away from the self-supporting holding element than at a location near the self-supporting holding element, and wherein the self-supporting holding element is adhered or welded to the brush body.

2. The brush according to claim 1, wherein the self-supporting holding element is of a plate-like design and is accommodated in the brush body.

3. The brush according to claim 1 wherein the self-supporting holding element is positively accommodated in the brush body.

4. The brush according to claim 1, wherein the bristle insert is overmolded.

5. A brush comprising:

a brush body comprising a handle;

a bristle insert attached to the handle and including at least one bristle pack with a plurality of plastic bristles having ends that are fused to each other to form a self-supporting holding element, wherein the at least one bristle pack includes different bristles that differ from each other in at least one of bristle thickness, bristle material, or bristle color;

wherein the self-supporting holding element is a plate, and wherein the bristle pack includes a cavity adjacent to the self-supporting holding element, and wherein the cavity is comparatively sharply delimited in direct vicinity of the self-supporting holding element, and wherein more bristles extend into the cavity at an increasing distance away from the self-supporting holding element than at a location near the self-supporting holding element; and wherein the brush body includes a collar which surrounds the at least one bristle pack.

6. A brush comprising:

a brush body comprising a handle;

a bristle insert attached to the handle and including at least one bristle pack with a plurality of plastic bristles having ends that are fused to each other to form a self-supporting holding element, wherein the at least one bristle pack includes different bristles that differ from each other in at least one of bristle thickness, bristle material, or bristle color;

wherein the self-supporting holding element is a plate, and wherein the bristle pack includes a cavity adjacent to the self-supporting holding element, and wherein the cavity is comparatively sharply delimited in direct vicinity of the self-supporting holding element, and wherein more bristles extend into the cavity at an increasing distance away from the self-supporting holding element than at a location near the self-supporting holding element; and wherein the brush body is made of two parts which are connected with each other.

* * * * *